US005939822A

United States Patent [19]

Alderson

[11] Patent Number: 5,939,822

[45] Date of Patent: Aug. 17, 1999

[54] SUPPORT STRUCTURE FOR FLAT PANEL DISPLAYS

[75] Inventor: Richard K. Alderson, Phoenix, Ariz.

[73] Assignee: Semix, Inc., Fremont, Calif.

[21] Appl. No.: 08/914,291

[22] Filed: Aug. 18, 1997

Related U.S. Application Data

[63] Continuation of application No. 08/352,711, Dec. 5, 1994, abandoned.

[51] Int. Cl.[6] ..... H01J 1/62

[52] U.S. Cl. ..... 313/493; 313/495; 313/496

[58] Field of Search ..... 313/309, 336, 313/351, 495, 496, 497

[56] References Cited

U.S. PATENT DOCUMENTS

| | | | |
|---|---|---|---|
| 2,967,012 | 1/1961 | Connor | 230/69 |
| 2,983,433 | 5/1961 | Lloyd et al. | 230/69 |
| 3,172,597 | 3/1965 | Guyot | 230/69 |
| 4,137,486 | 1/1979 | Schwartz | 315/366 |
| 4,143,296 | 3/1979 | Stanley | 313/422 |
| 4,158,157 | 6/1979 | Schwartz | 315/366 |
| 4,180,760 | 12/1979 | Chang | 313/422 |
| 4,308,484 | 12/1981 | Carroll et al. | 313/402 |
| 4,339,694 | 7/1982 | Ohkoshi et al. | 315/366 |
| 4,389,165 | 6/1983 | Ono et al. | 417/49 |
| 4,473,834 | 9/1984 | Soclof | 357/17 |
| 4,484,103 | 11/1984 | Credelle | 313/422 |
| 4,532,454 | 7/1985 | Abdalla | 313/506 |
| 4,570,100 | 2/1986 | Sato et al. | 313/422 |
| 4,651,049 | 3/1987 | Saeki et al. | 313/355 |
| 4,874,981 | 10/1989 | Spindt | 313/309 |
| 4,881,005 | 11/1989 | Morimoto et al. | 313/422 |
| 4,908,539 | 3/1990 | Meyer | 315/169.3 |

(List continued on next page.)

OTHER PUBLICATIONS

R. Hawley, "Solid Insulators in Vacuum: A Review", C A Parsons & Co Ltd, Heaton works, Newcastle upon Tyne 6, pp. 383–390, 1968, Dec. 31, 1968.

*Primary Examiner*—Nimeshkumar D. Patel

*Attorney, Agent, or Firm*—Burns, Doane, Swecker & Mathis LLP

[57] ABSTRACT

A support structure is provided that enables the use of high-voltage phosphors in field-emission flat panel displays, to maintain the vacuum gap between the cathode and the anode at a constant distance and to prevent distortion of the transparent view screen and backing plate of the display. A number of independent techniques each contributes to the solution of the problem of secondary electron emission. One technique is to alter the geometry of the triple junction of the support structure, the cathode, and the vacuum gap, thereby reducing the electrostatic field created at the triple junction. Reducing the electrostatic field reduces the initial primary electron bombardment originating at the triple junction. Altering the geometry of the support surface with respect to the field lines present at the triple junction also increases the probability that impinging electrons will impact at or nearly at right angles, and will also tend to be directed by the field lines back into the "pocket" created by the shaping of the support structure edge, preventing secondary electrons from escaping and traveling along the structure surface to the anode. In accordance with another technique, the support structure is fluted so as to reduce the average coefficient of secondary electron emission, to trap a proportion of secondary electrons, and to limit the number of hops of other secondary electrons. In another technique, a high resistivity conductive layer is formed at the triple junction in order to reduce the field potential at the triple junction. A similar conductive layer may be formed at the opposite junction of the support structure, the anode, and the vacuum gap. A high resistivity conductive material coated on the surface of the insulating spacer can be used to decrease the charge relaxation time of the insulator, thereby maintaining a constant field potential over the surface of the insulator, reducing areas of high field potential which will tend to accelerate secondary electron emissions. In accordance with other techniques, the support structure is made of a non-porous material and may be coated with a coating having low secondary emission characteristics.

22 Claims, 6 Drawing Sheets

U.S. PATENT DOCUMENTS

| | | | |
|---|---|---|---|
| 4,924,148 | 5/1990 | Schwartz | 315/169.4 |
| 4,940,916 | 7/1990 | Borel et al. | 313/306 |
| 5,015,912 | 5/1991 | Spindt et al. | 313/495 |
| 5,057,047 | 10/1991 | Greene et al. | 445/24 |
| 5,063,327 | 11/1991 | Brodie et al. | 313/482 |
| 5,075,591 | 12/1991 | Holmberg | 313/495 |
| 5,216,324 | 6/1993 | Curtin | 313/422 |
| 5,386,175 | 1/1995 | Van Gorkom et al. | 313/422 |

SUPPORT STRUCTURE FOR FLAT PANEL DISPLAYS

This application is a continuation of application Ser. No. 08/352,711, filed Dec. 5, 1994 now abandoned.

BACKGROUND OF THE INVENTION

1. Field of the Invention

The present invention generally relates to flat panel displays in which internal supports maintain a gap between a view screen of the display and an electron emitting surface, and, more particularly, to internal support structures used in such flat panel displays.

2. State of the Art

Cathode ray tubes (CRTs) are widely used as display monitors for television sets, computers and other devices to visually display information. CRTs exhibit images of high quality in terms of contrast, resolution, brightness and color, and respond quickly to image changes. These desirable characteristics are achieved using a luminescent phosphor coating on the interior of the CRT screen. The advantages of CRTs in terms of image quality are overshadowed in many applications by the size, weight and power consumption of CRTs, which require considerable space behind the view screen for the cathode ray tube and associated deflection yokes. Conventional CRTs are too large and cumbersome for use in certain applications including compact portable computers, instrument panels of aircraft, etc.

Substantial research and development efforts have been made to achieve a so-called "flat panel display" which does not require as great a physical depth behind the view screen as a CRT, but which exhibits display characteristics comparable to those of a CRT. These efforts have produced flat panel displays which exhibit utility in certain applications, but which do not provide the high contrast, resolution, brightness and color attributes of a CRT. Various liquid crystal technologies have resulted in displays with the desired thin depth behind the view screen, but which suffer from lack of contrast, brightness and color (or chrominance), and which are also slower in response to changes in the displayed image (screen refresh). Active Matrix LCDs have shown improved contrast, resolution, brightness, chrominance, and screen refresh, but at a very high cost and with very substantial power requirements.

Known flat panel displays use field emission cathodes and luminescent phosphors similar to those used in CRTs, but nevertheless suffer from certain inherent limitations. These flat panels displays include the matrix-addressed flat panel displays disclosed in the following U.S. Patents, which are incorporated herein by reference: U.S. Pat. No. 3,500,102 to Crost et al., U.S. Pat. Nos. 4,857,799 and 5,015,912 to Spindt et al., and U.S. Pat. No. 5,063,327 to Brodie et al. As generally described in the foregoing patents, a cathode layer is formed of a semiconducting material on a backing structure. Electron-emitting tips are formed within the semiconducting material, and electrical connections are made to the electron-emitting tips. An anode layer is formed on the inside surface of a transparent view screen, and phosphors are coated on the anode layer. The backing structure and the view screen are spaced apart by insulating spacers and sealed together to form an envelope that is evacuated. In operation, the phosphors react to bombardment by electrons by emitting visible light.

As compared to current CRT technology, which uses voltages in the 20 kV range, the flat panels displays disclosed in the foregoing patents are limited by their physical characteristics to the use of a relatively low voltage differential (well under 5 kV and typically in the range of 200 to 1000V) between the display's cathode and anode. Because of the physical arrangement of current field-emitter-based flat panel displays, attempts to use higher voltages generally results in the occurrence of a short circuit between the cathode layer and the anode layer of the device. In particular, when relatively high voltage differentials are used to power the display, the phenomenon of secondary electron emission often produces an electron multiplication effect, causing electrical shorts to develop between the cathode (electron source) and anode (view screen) along the surface of the spacers within the vacuum envelope.

Spacers or other support structures are used to prevent distortion of the view screen or backing plate of the display due to the force of atmospheric pressure upon the planar evacuated chamber. As described in U.S. Pat. No. 5,015,912 to Spindt, et al., these spacers maintain the vacuum gap between the phosphors and the cathodes at a selected distance. Distortion of either of the two planar surfaces would result in shortening of the vacuum gap, leading to the electron avalanching phenomena described in Spindt, et al.

The support structures described in the prior art generally intersect the cathode of the display at a 90° angle, creating a "triple junction" of the support structure, the cathode, and the vacuum gap. Referring to FIG. 1, in a conventional field-emission flat panel display having a view screen 1, a cathode backing structure 2 and a vacuum gap 4, a support structure 3 exhibits a 90° angle at the triple junction of the support structure 3, the cathode 2 and the vacuum gap 4. The trajectory of a typical secondary electron is illustrated as a series of hops 5.

Because the support structure possesses a different dielectric constant than that of the vacuum gap, an electrostatic field is generated. The triple junction causes a distortion of the field by intensifying the field at the junction as shown in FIG. 2. The distortion in the electrostatic field causes electrons to be attracted to the surface of the support structure. When these electrons impinge upon the surface of the support structure, secondary electron emission results. Secondary electrons are emitted from the surface of the support structure into the vacuum gap and are drawn toward the anode by electrical attraction. Through the action of the described electrostatic field, the secondary electrons are caused to traverse a curved path back onto the surface of the support structure, where they impinge upon the support structure surface and cause the emission of further secondary electrons, which follow a similar, though shortened, trajectory, repeating this action along the surface of the support structure toward the anode.

Because each successive cycle of secondary electron emission results in shorter trajectories, or "hops," the incidence of secondary electron emissions grows as the hops move along the support structure surface toward the anode. Since the materials commonly used for support structures exhibit high secondary electron emission characteristics, each successive hop also generates more secondary electrons. At relatively high-voltage ranges, the secondary emission of electrons is increased, and a chain reaction can result. The electrical effect of the emission of secondary electrons and their migration to and collection at the junction of the anode with the support structure is to positively charge the support structure, shortening the effective electrical length of the support structure and causing arcs to form between the anode and cathode layers (i.e., shorting out the device at its support structure).

The generally straight, smooth surfaces of prior art support structures also encourage increased secondary electron emission at higher voltages. With a flat surface, the emitted secondary electrons escape at various angles and, by action of the electrostatic field present, return to the surface of the support structure at various angles to strike the surface and cause additional secondary emissions of electrons. As shown in FIG. 3, electrons striking the surface at oblique angles will tend to plow into the surface and eject more secondary electrons than those electrons striking the surface at or nearly at right angles to the surface.

Since the physical characteristics of prior art field-emission flat panel displays limit the displays to low voltage differentials (usually around 200 to 1000V), low-voltage phosphors, which lack the luminescent efficiency of the high-voltage phosphors used in conventional CRTs, must be used.

The use of high-voltage phosphors in a field-emission flat panel display would result in a number of advantages over the use of low-voltage phosphors in such a display. High-voltage phosphors as used in current CRT displays (usually operating at voltage differentials of 20 kV and higher) require substantially less power to generate the same amount of light energy as low-voltage phosphors. (It should be noted that the very high power requirements of CRTs are not due to the use of high-voltage phosphors. The ratio to total power of the power used by a CRT to generate the image is very small. The vast majority of the power used by a CRT is used in generating and controlling the electron flow necessary to excite the phosphors through the use of an electromagnetic deflection yoke. In addition, as a result of the scanning of the electron beam across the phosphor screen, only 10% to 20% of the power of the excitation beam actually reaches the phosphors. Approximately 80% to 90% of the power of the electron beam is wasted on the shadow mask (non-illuminating) portions of the CRT screen. In a field-emission flat panel display, since there is no beam scanning, no such waste of power occurs. Power consumption is of vital concern in field-emission flat panel displays, especially where portability of the display requires the use of battery power. The same is frequently also true for small terminal displays for use in automotive or aircraft applications where the power is self-generated and is limited in supply.) Low-voltage phosphors also exhibit inferior chrominance compared to high-voltage phosphors, resulting in a comparative loss of clarity of colors and a muddy appearance of the display. Chrominance is an important consideration in achieving market acceptance of a flat panel display, as the end user has been conditioned to desire, even require, the bright color and clarity obtainable on current CRT displays.

High-voltage phosphors also exhibit a much longer average life over low-voltage phosphors (at least six times longer life). This factor is very important to market acceptance of a flat panel display, as the end user has come to expect the longer average life of the high-voltage phosphor CRT display.

High-voltage phosphors also permit the use of a metallizing layer to contain the phosphors between the metallizing layer and the transparent display screen. A metallizing layer cannot be used with low-voltage phosphors, since electron penetration varies as the square of electron energy (measured in electron volts), and the electrons emitted by a low-voltage device are less able to penetrate the metallizing layer and reach the phosphor layer in order to excite the phosphor layer and cause light energy to be generated.

One benefit of using a metallizing layer is that the metallizing layer prevents back-scattering of light emitted by the phosphor layer. For example, aluminium has a reflectivity of 90%, reflecting 90% of back-scattered light energy through the transparent view screen and thereby increasing screen brightness by approximately 70%.

Another benefit of using a metallizing layer is that it helps contain the phosphors at the screen surface. Containment is important in preventing phosphor flaking off the screen surface and contaminating the vacuum gap. Phosphor contaminants may deposit themselves in the field-emitter apertures, which interferes with their operation and may even cause shorting and destruction of the contaminated emitter. Low-voltage phosphors require the use of more binders than high-voltage phosphors to prevent phosphor flaking. The greater binder content of low-voltage phosphors further degrades their performance.

The metallizing layer also acts as an electron drain, completing the electrical circuit which begins at the emitter without interfering with the output of light from the transparent display screen. In low-voltage phosphor devices, a semitransparent conductor is usually incorporated on the transparent display screen to complete the electrical circuit. Because the conductor is semi-transparent, it reduces the output of light from the phosphors through the screen, further degrading the brightness of the display image.

The effect of the physical limitation of the prior art to a low voltage differential is to limit the device to the use of low-voltage phosphors, resulting in an image at the display screen that exhibits inferior chrominance and reduced brightness and a display that exhibits decreased life and greater power requirements than a comparable device using a high voltage differential and high-voltage phosphors.

A difficult problem in the use of high-voltage phosphors in field-emission flat panel displays, however, is that the operating voltage differentials required by such phosphors can be between 20 to 100 times those required by low-voltage phosphors. This greatly-increased voltage requires that the vacuum gap between the cathode and anode in a high-voltage flat panel display be increased by a factor of 20 to 100 times that of a low-voltage flat panel display.

The increased vacuum gap increases the demand on support structures to maintain the vacuum gap at a constant distance and to prevent distortion of the view screen and backing panel of the display. With increased vacuum gap distances, the support structure must be made taller. Maling the support structure taller results in turn in an increase in the smooth, flat support structure surface between the anode and cathode, exacerbating the secondary electron emission effect As described above, the trajectory of each successive secondary electron emission is shorter than the preceding emission. With a longer distance to travel to the anode along the support structure surface, the instances of secondary electron emissions are multiplied geometrically.

The increased height of the support structure in a high-voltage flat panel display device therefore requires methods to control and reduce secondary electron emissions.

SUMMARY OF THE INVENTION

The present invention, generally speaking, provides a support structure that enables the use of high-voltage phosphors in field-emission flat panel displays, to maintain the vacuum gap between the cathode and the anode at a constant distance and to prevent distortion of the transparent view screen and backing plate of the display. The present invention encompasses a number of independent techniques, each of which contributes to the solution of the problem of secondary electron emission along the surfaces of the support structures. Secondary emission can result in shorting of the cathode to the anode along the support structures of field-emission flat panel displays when using high voltage differentials across the vacuum gap of the display. One technique for reducing secondary electron emission along the surface of the support structure is to alter the geometry of the triple junction of the support structure, the cathode, and the vacuum gap, thereby reducing the electrostatic field created at the triple junction. Reducing the electrostatic field reduces the initial primary electron bombardment originating at the triple junction. Altering the geometry of the support surface with respect to the field lines present at the triple junction also increases the probability that impinging electrons will impact at or nearly at right angles, and will also tend to be directed by the field lines back into the "pocket" created by the shaping of the support structure edge, preventing secondary electrons from escaping and traveling along the structure surface to the anode. In accordance with another aspect of the invention, the support structure is fluted so as to reduce the average coefficient of secondary electron emission, to trap a proportion of secondary electrons, and to limit the number of hops of other secondary electrons. In another aspect of the invention which acts to reduce secondary emissions, a high resistivity conductive layer is formed at the triple junction in order to reduce the field potential at the triple junction. A similar conductive layer may be formed at the opposite junction of the support structure, the anode, and the vacuum gap. A high resistivity conductive material coated on the surface of the insulating spacer can be used to decrease the charge relaxation time of the insulator, thereby maintaining a constant field potential over the surface of the insulator, reducing areas of high field potential which will tend to accelerate secondary electron emissions. In accordance with other aspects of the invention, the support structure is made of a non-porous material. In accordance with other aspects of the invention, the support structure may be coated with a coating having low secondary emission characteristics. In accordance with another aspect of the invention, a conductive layer can be placed at the edges of the support structure where it interfaces with the cathode or anode plates. This conductive layer assures a constant field potential along the interfaces to defeat primary electron generation due to high field distortions. In accordance with another aspect of the invention, the support structure can be easily manufactured as a free-standing unit.

BRIEF DESCRIPTION OF THE DRAWING

The present invention may be further understood from the following description in conjunction with the appended drawing. In the drawing.

DETAILED DESCRIPTION OF THE PREFERRED EMBODIMENTS

In the following description of the present support structure for flat panel displays, numerous specific details are set forth, such as specific materials, dimensions, etc., in order to provide a thorough understanding of the present invention. It will be obvious, however, to one skilled in the art that these specific details need not be employed to practice the present invention.

Figure 1:
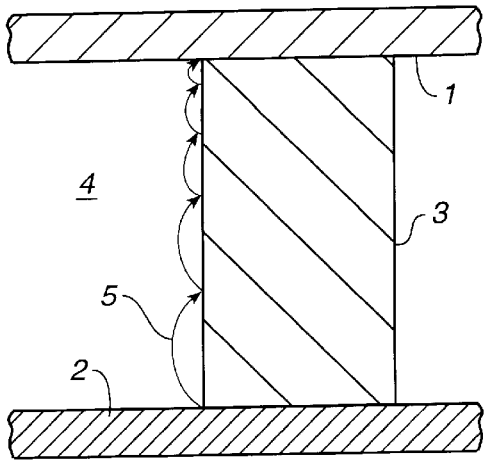
FIG. 1 (PRIOR ART)
FIG. 1 is an end view of the support structure of a conventional field-emission flat panel display, exhibiting a right angle at the triple junction of the support structure surface, the cathode surface, and the vacuum gap.
Figure 2:
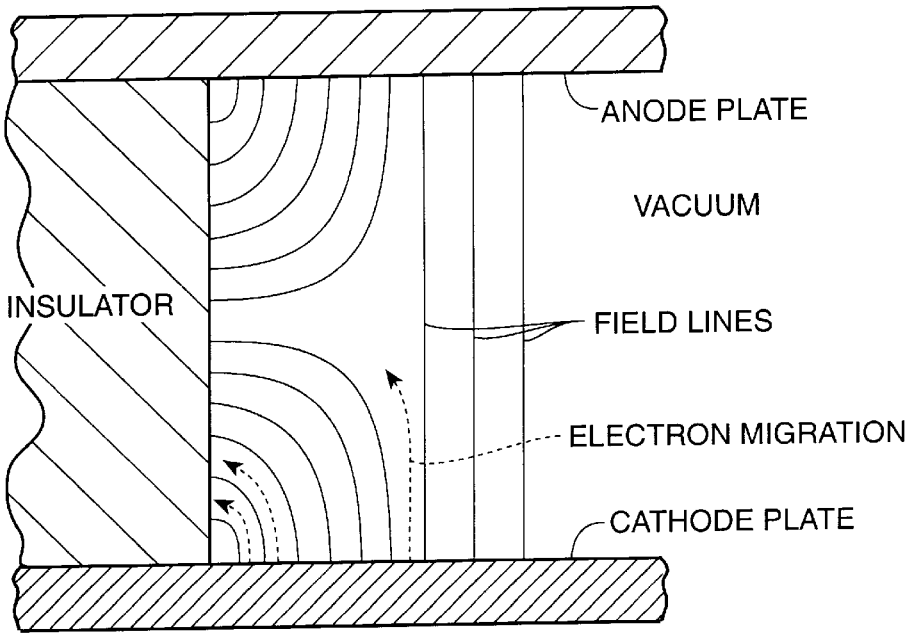
FIG. 2 is an end view of the support structure of a conventional field-emission flat panel display exhibiting a right angle at the triple junction, showing distortion of the electric field and consequent electron migration from the cathode toward the anode.
Figure 3:
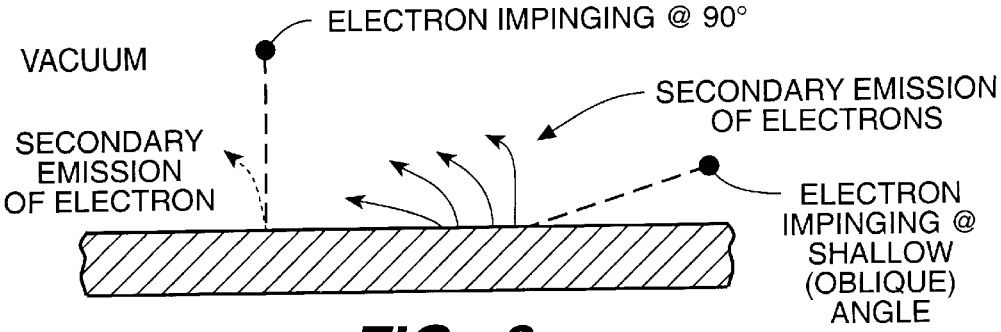
FIG. 3 is a diagram illustrating the effect of the angle of impact of a primary electron on the number of secondary electrons emitted.
Figure 4:
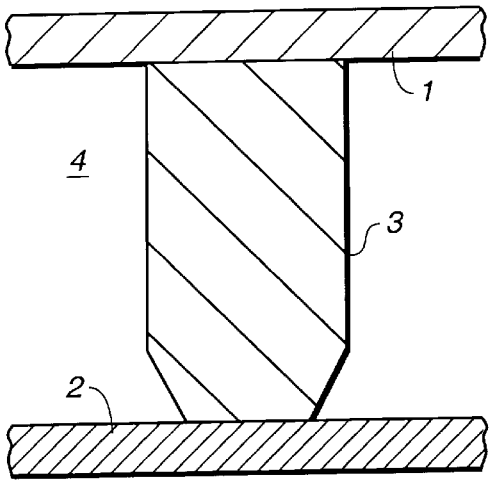
FIG. 4 is an end view of the support structure of a field-emission flat panel display in accordance with one embodiment of the present invention, in which a right angle at the triple junction is eliminated.

Referring to FIG. 4, the problem of secondary electron emission in field-emission flat panel displays is addressed in accordance with a first aspect of the invention by altering the geometry of the triple junction between the support structure, the cathode, and the vacuum gap. The sides of the support structure 3 are shaped at their interface with the cathode 2 and the vacuum gap 4 so as to alter the geometry of the triple junction. This technique reduces the initial primary electron flow "hopping" onto the sides of the support structure by reducing the electrostatic field and by controlling the angle at which the impinging primary electrons strike the support structure surface. The altered geometry contributes to keeping such impacts at or nearly at right angles to reduce the emission of secondary electrons. The nearer to 90° that an impinging electron strikes the surface, the fewer secondary electrons will be emitted. At more oblique angles, the impinging electron will tend to plow across the surface of the support structure to eject more secondary electrons.

The altered geometry of the support surface at the triple junction effected by shaping the support also changes the surface's orientation to the field lines present at the triple junction. Secondary electrons generated at or near the triple junction will tend to be forced by the action of the field lines back into the "pocket" formed by the shaping of the support's edge, and will tend to lack the energy necessary to escape the pocket.

The ends of the support structure can also be shaped in similar fashion to the support structure edges to reduce the probability of a breakdown occurring where the ends butt against the sides of the flat panel display device.

Figure 5:
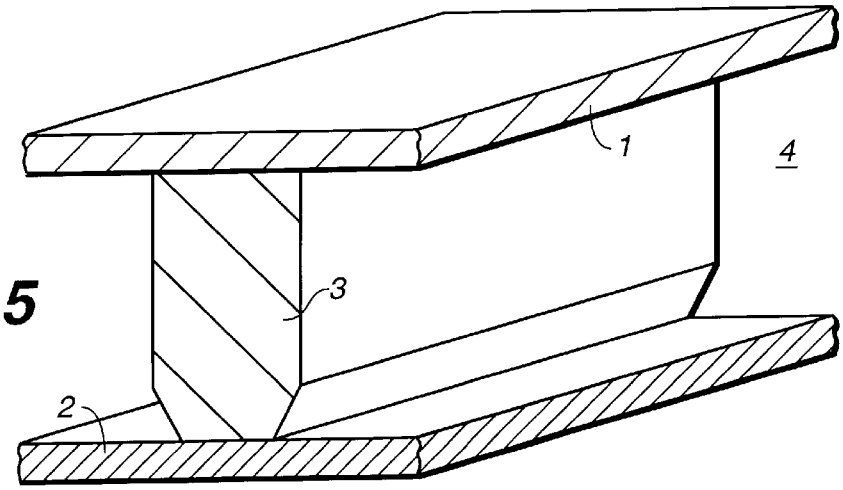
FIG. 5 is a three-quarter view of the support structure of FIG. 4.

The support structure 3 of FIG. 4 is shown in greater detail in FIG. 5.

A second technique for reducing secondary electron emissions and electron multiplication along the surface of the support structure is to provide grooves or channels, referred to as "fluting," along the sides of the support structure across the path of the flow of secondary electrons from the cathode to the anode-that is, parallel to the view screen and the electron emitting surface of the display. The fluting can be of various shapes, and can be composed of angular, rectangular or rounded channels or grooves in the sides of the support structure.

Figure 6:
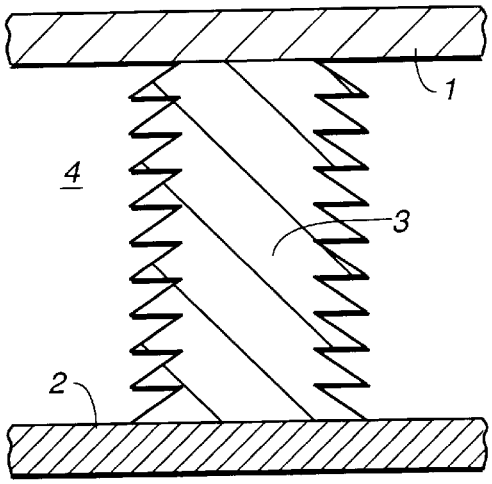
FIG. 6 is an end view of the support structure of a field-emission flat panel display in accordance with another embodiment of the present invention, in which flutings are cut or molded into the sides of the support structure to reduce secondary electron emissions.
Figure 7:
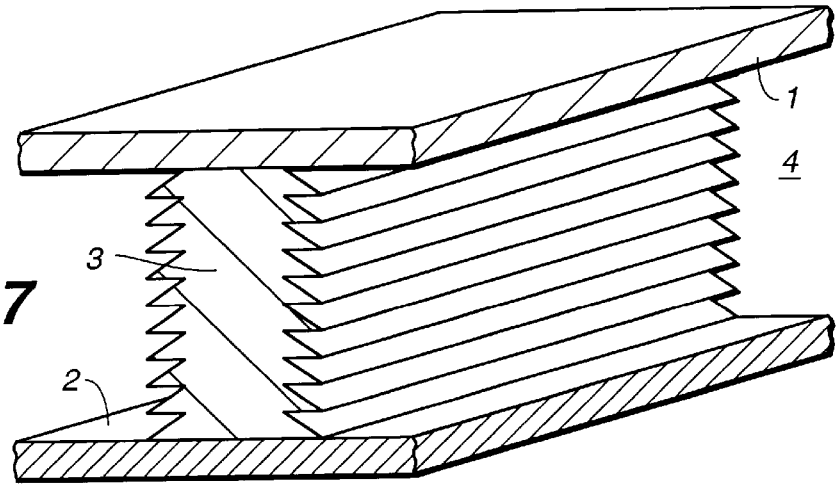
FIG. 7 is a three-quarter view of the support structure of FIG. 6.

Referring to FIG. 6, showing one possible configuration of the fluting, the support structure 3 exhibits saw-tooth-type fluting provided in the sides. The support structure 3 therefore, besides maintaining the vacuum gap 4 between the anode 1 and the cathode 2, reduces secondary electron emission. The support structure 3 of FIG. 6 is shown in greater detail in FIG. 7.

Figure 8:
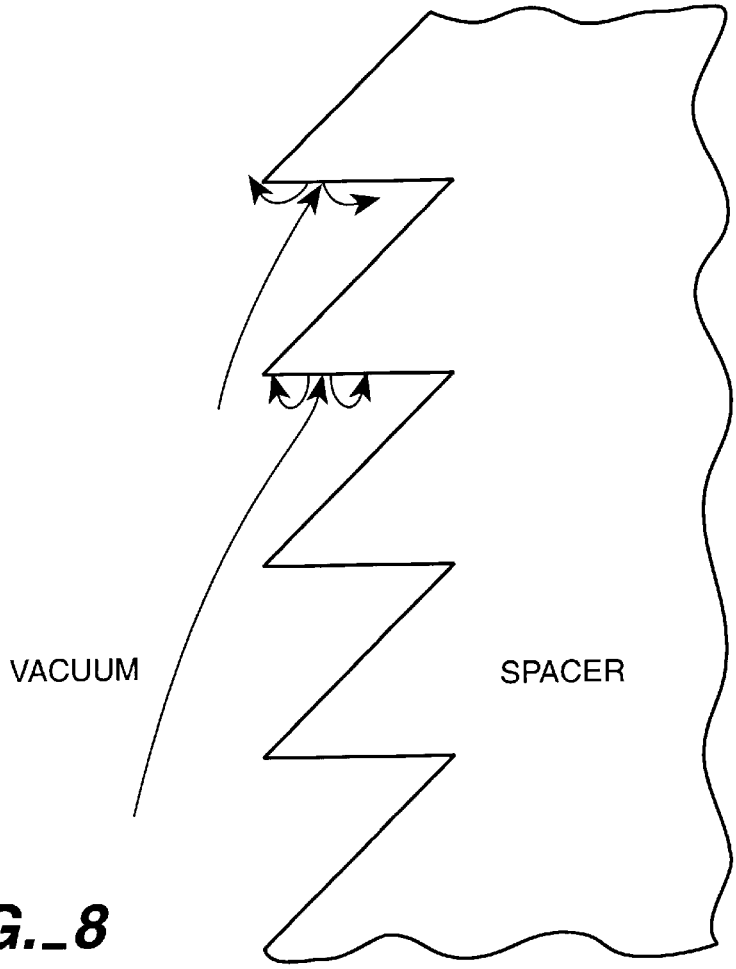
FIG. 8 is an exploded view of a portion of the fluted surface of the support structure of FIG. 6, illustrating the effects of more direct incidence and of electron trapping.

The fluting reduces secondary electron emissions in three ways. As previously described, with a smooth-sided support structure, secondary electrons will impinge upon the side of the support structure at various angles. A number of these impinging electrons will strike the surface at oblique angles. As illustrated in FIG. 8, by altering the orientation of the surface of the support structure with reference to the field lines of the electrostatic field present along the support structure surface, the flutings increase the probability that secondary electrons will impinge upon the surface at or nearly at right angles, reducing the number of secondary electrons emitted as a result of the impacts.

Also as illustrated in FIG. 8, the alteration of the orientation of the surface of the support structure to the field lines of the electrostatic field allows the fluting to act as a trap for secondary electrons. On a smooth-sided support structure, secondary electrons emitted by electron impacts will be emitted in all directions and at various angles. By the action of the electrostatic field, all of the secondary electrons ejected by the impact will move in a curved trajectory, determined by the energy and angle at which they were emitted, toward the anode then back to the surface of the support structure, where they will impinge upon the surface. The fluting's shape alters the geometry of the surface of the spacer in relation to the electrostatic field lines such that most secondary electrons emitted by an impinging electron will describe a trajectory back into the fluting, rather than out of the fluting's "mouth." Due to the necessarily short trajectories within the fluting, the secondary electrons experience much less field acceleration and exhibit reduced energy (and velocity), reducing the output of secondary emissions on impact. In effect, these secondary electrons are "trapped" within the fluting. Even some of those secondary electrons that resulting from a primary impact and that travel toward the mouth of the fluting are, due to the altered geometry of the impact surface to the electrostatic field lines, guided back into the fluting, becoming trapped. Relatively fewer electrons escape the fluting to renew the secondary emission process closer to the anode along the support surface.

Finally, the flutings act to reduce the number of hops a secondary electron and its progeny will make across the surface of the support structure toward the anode. To illustrate the effect of a tall (e.g., 1500 micron), smooth-sided support structure, assume that the trajectory of a secondary electron is 0.1 microns long in the direction from cathode to anode, and that each electron impact will generate an average of 1.01 secondary electrons. For purposes of illustration only, further assume that the device has an unlimted supply of power. The theoretical result will then be a total electron collection of $6.6\times10^{64}(1.01\times10^{15,000})$ electrons at the anode, resulting in shorting of the device at the support structure. Of course, the device could physically not have this level of current available to it. The example shows, however, that with a smooth-sided support structure, all or nearly all the current available to the device would flow along the side of the support structure as a result of secondary emission of electrons. This example also illustrates why it is important to reduce the secondary electron emission coefficient to less than one per impact.

By trapping within the flutings secondary electrons impacting within the flutings, a low secondary emission characteristic is obtained. For example, by providing flutings spaced so as to present tips every 10 microns, for a total of 150 such points across the surface of the support structure, a secondary electron and its progeny will be limited to 150 hops across the support structure's 1500 micron height. Assuming a limit of 150 hops, the electron collection at the anode will be $4.4(1.01\times10^{150})$ electrons.

Figure 9:
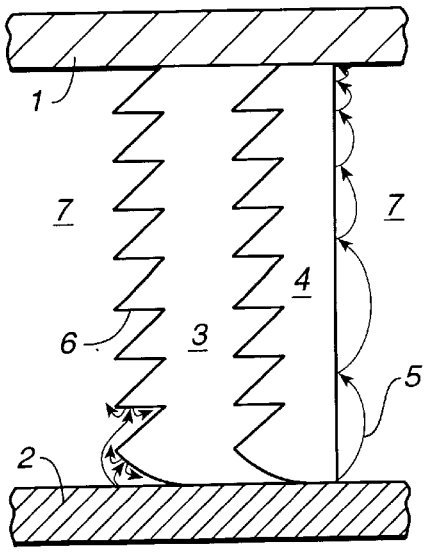
FIG. 9 is a composite end view of both the support structure of FIG. 6 (left side) and the conventional support structure of FIG. 1 (right side), illustrating different secondary electron emission characteristics.

The effect of the fluting in reducing secondary electron emission as compared to conventional flat spacers is illustrated in FIG. 9. Whereas conventional spacers (right-hand side) allow electrons to multiply as they travel toward the anode in progressively shorter hops, the fluted spacer (left-hand side) reduces the average coefficient of secondary electron emission, traps a proportion of secondary electrons, and limits the number of hops of other secondary electrons.

The fluting also permits control of the ion current created by the secondary emission of electrons along the surface of the support structures. The electron impacts may stimulate gas molecules, encountered as an electron enters the surface of the support structure, to ionize and escape the support structure. The ionization charges the molecule positively, and the molecule is then attracted along the lines of electrostatic field to the cathode. The path of the ion toward the cathode describes a curve back to the surface of the support structure, resulting in the ion's impinging the surface. The impact ejects secondary electrons, enhancing the secondary emission effect. By significantly reducing the number of emissions of secondary electrons at each impact, the fluting reduces the probability of ionization of gas molecules and reduces the probability of further emission of secondary electrons as a result of ion impacts.

Figure 10:
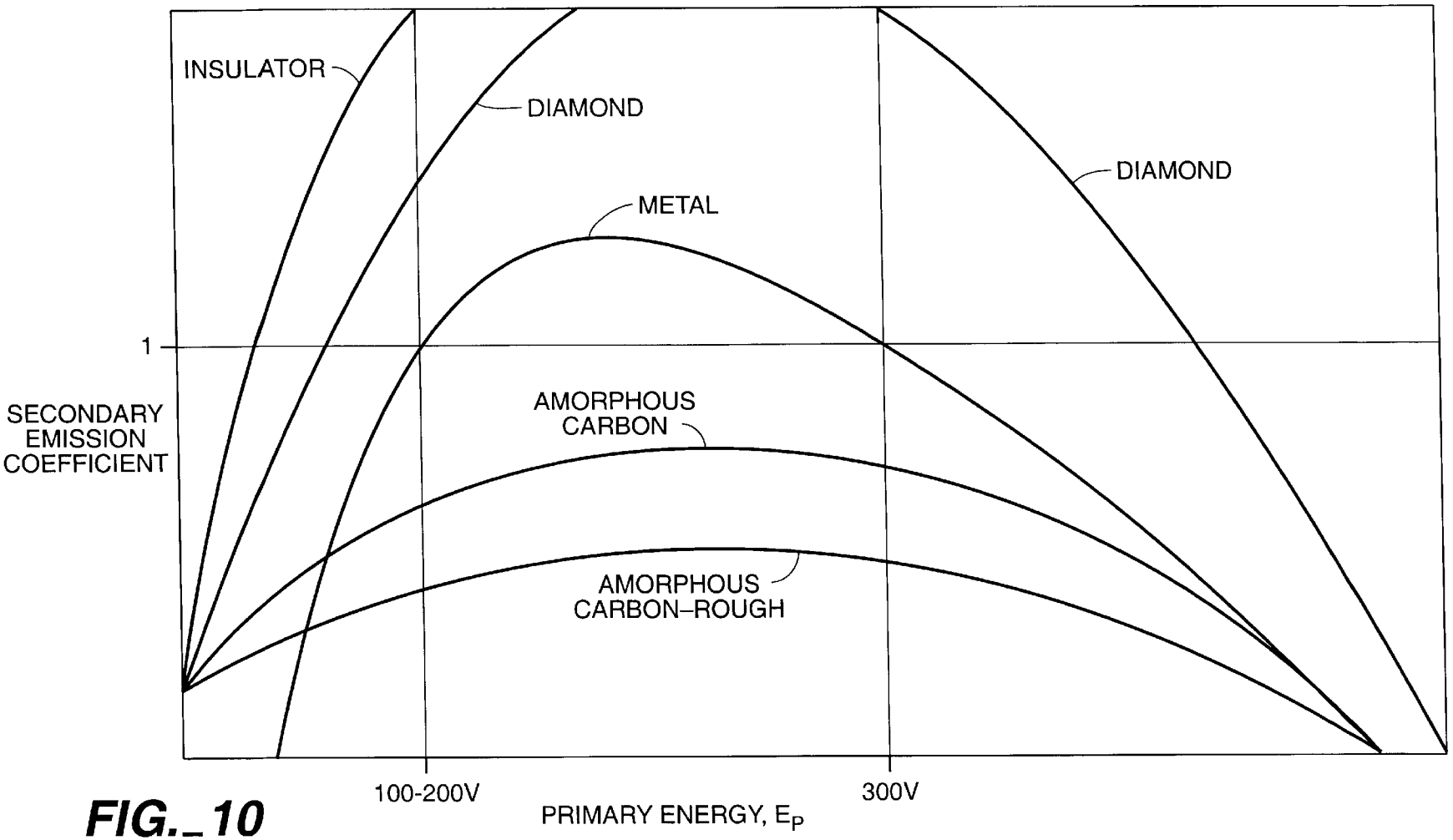
FIG. 10 is a graph illustrating the secondary emission characteristics of serveral common materials.

A certain number of flutings can be equally spaced along a support structure's sides to reduce secondary emission by matching the number of flutings to the secondary emission characteristics of the particular material used in the support structure or its coating. Every material has certain secondary emission characteristics by which the material's secondary emission coefficient will vary as a function of the voltage at a given length along the material's surface. The secondary emission characteristics of several common materials are shown in FIG. 10. The number of flutings employed should be chosen such that, for the selected material, the voltage drop per flute is less than the voltage at which the secondary emission coefficient for the material is 1.0. For example, assuming a material whose secondary emission coefficient drops below 1.0 at 200 volts, and further assuming a device having an operating voltage of 20 kV, the number of flutings may be 100, which results in 200 volts between each of the flutings (20 kV divided by 100), thereby reducing the threshold voltage to 200 volts at each impact. The key is to reduce the secondary emission coefficient to less than one so that the probability of secondary emissions of electrons is reduced.

Another technique for reducing secondary electron emission along the side of the support structure is to use non-porous materials, for example (but not in any way limiting the choice of materials) glass. By reducing the porosity of the surface of the support structure, the probability of gases being trapped in the porous surface is reduced. As described above, these gases, when impinged by electrons, result in the secondary emission of ions. The ions create an ion current toward the cathode, and in the process of traveling along the electrostatic field to the cathode, impinge upon and eject additional secondary electrons.

Secondary electron emission may also be reduced by coating the support structure with a low secondary emission material such as Chromium Oxide. The low secondary emission qualities of such materials will reduce the number of secondary electrons emitted along the support structure sides.

Figure 11:
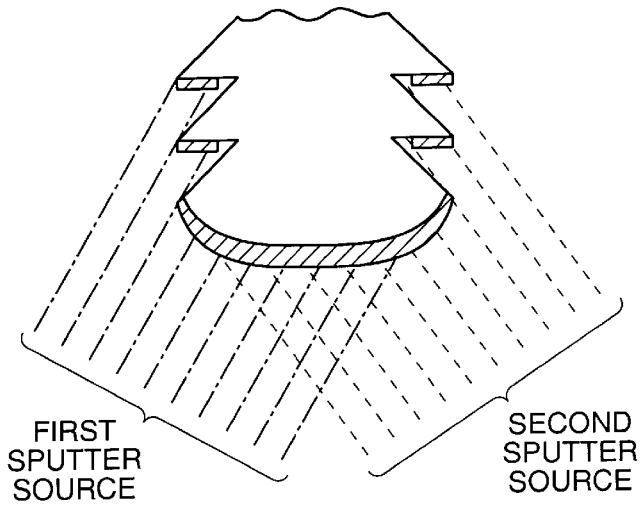
FIG. 11 is a cross-sectional view of a portion of a support structure combining the features of FIG. 4 and FIG. 6, illustrating the use of shadow sputtering to deposit regions of low-secondary-emission material.

A low secondary emission material may be coated non-uniformly on a support structure provided with the fluting. For example, by sputtering low secondary emission material onto the support structure at an angle relative to the cathode edge, shadow sputtering can be accomplished whereby the low secondary emission material is deposited only in the vicinity of the cathode-facing fluting "over-hangs," as shown in FIG. 11. These surfaces are those that receive the incoming primary electrons, and which therefore require low secondary emission characteristics to reduce emissions. (The same sputtering method may also be used to deposit a conductive coating on the cathode edge of the support structure to accomplish a constant potential as discussed in detail below.)

Secondary electron emission can also be controlled by ensuring constant charge along the support structure (insulator) sides. Charge potential builds up along the structure (insulator) sides during operation of the device. While charge is constantly bled off as a function of the relaxation time of the particular insulator used to make the structure, there is a tendency for the structure to have a higher charge potential at the center of the structure sides due primarily to the long relaxation time of an insulator. The higher charge potential in the center will tend to accelerate electrons, decreasing the trajectory of secondary electrons and increasing the frequency of secondary electron emission, ultimately leading to shorting of the device along the support structure.

Figure 12:
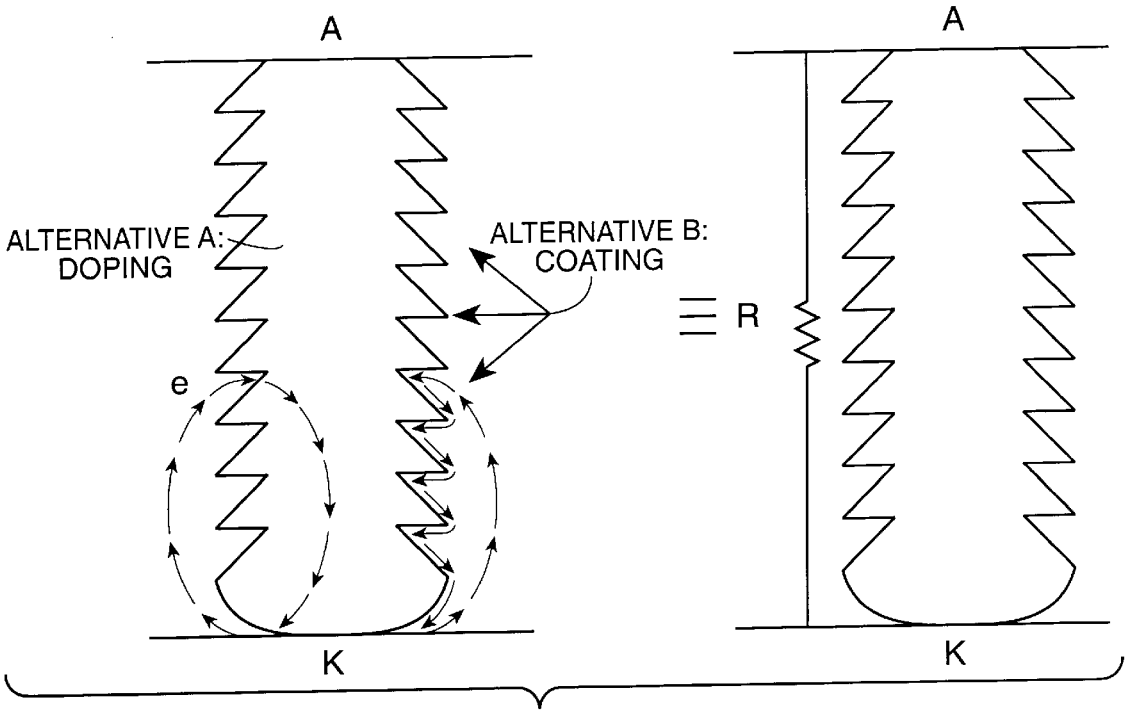
FIG. 12 is a cross-sectional view of the support structure of FIG. 11, illustrating the use of high-resitivity conductive materials to decrease the charge relaxation time of the insulator.

Secondary electron emissions can be controlled by decreasing the relaxation time of the charge along the structure (insulator) sides so that the charge can be equalized. One method for decreasing relaxation time along the structure's sides is to coat the sides with a high resistivity semiconductor material, for example silicon oxide doped with chrome or amorphous silicon. Another method is to manufacture the support structure of a special semiconducting glass exhibiting relatively low resistivity, for example glass containing tin oxide. As shown in FIG. 12, the use of these materials decreases the relaxation time of the insulator, permitting faster bleed off of charge along the insulator surface. Reducing the relaxation time has the equivalent effect as placing a resistance R in parallel with the insulator, allowing the insulator to maintain constant charge potential along it sides, and reducing any high charge areas.

Figure 13:
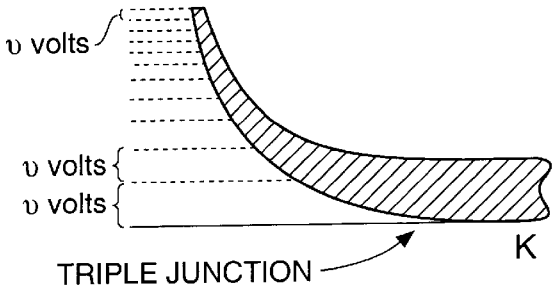
FIG. 13 is a cross-sectional view of a portion of the support structure of FIG. 11, illustrating the use of a variable-thickness, high-resistivity conductive coating to reduce field strength in the vicinity of the triple junction.

Another method for controlling secondary emissions of electrons is to reduce the field potential at the triple junction, whether the support structure is shaped or presents a right angle. This reduction is accomplished by creating a lower resistance at the cathode plate, for example by coating the support structure's edge with a layer of one or more high resistivity conductive materials, and varying the resistivity of the layer. The resitivity of the layer may be varied by varying the thickness of the resistive material, in which case the material would be thicker (exhibiting lower resistance) at the cathode plate, and becoming thinner (exhibiting increasing resistance) along the support structure at increasing distances from the cathode as shown in FIG. 13. Alternatively, the resitivity of the layer may be varied by using materials with different resistivity characteristics. The lower resistance at the cathode plate reduces the field potential at the triple junction, which serves to reduce the extraction of primary electrons.

Figure 14:
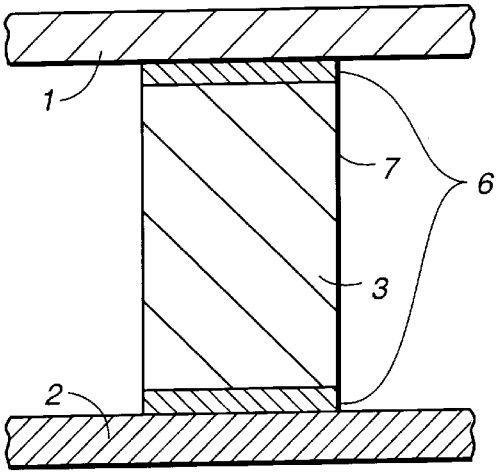
FIG. 14 is an end view of the support structure of a field-emission flat panel display in accordance with another embodiment of the present invention, in which a conductive material is used between the support structure and its contacts with the anode and cathode of the flat panel display.

Secondary electron emission can also be controlled by ensuring a constant potential along the support structure's interface with the transparent view screen and the electron emitting surface of the flat panel display. This can be accomplished, as illustrated in FIG. 14, by placing a layer of metal 6 along the contacts between the support structure 3 and the cathode layer 2, and between the support structure 3 and the anode layer 1. Without such a layer, high points in one or the other of the surfaces in contact would create contact points instead of continuous contact. This uneven contact results in the formation of field concentrations at the contact points which may interfere with the electron flow to the anodes, or which might increase secondary electron emissions, degrading the performance of the display.

Figure 15:
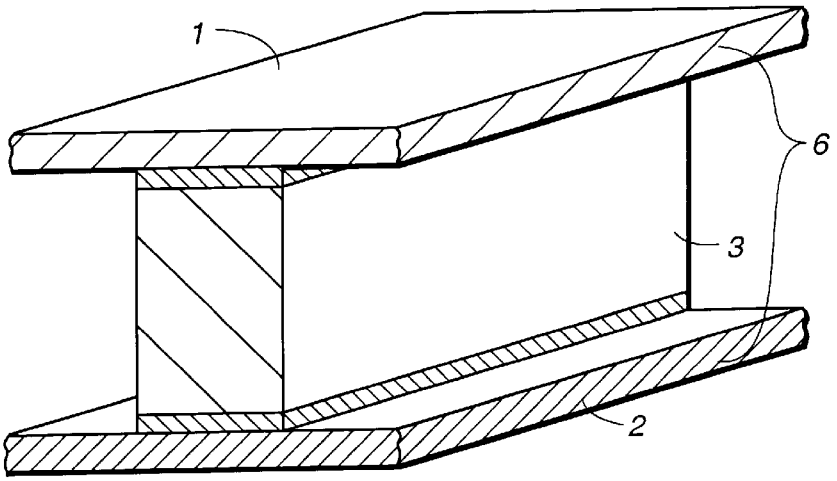
FIG. 15 is a three-quarter view of the support structure of FIG. 14.

The support structure 3 of FIG. 14 is shown in greater detail in FIG. 15.

The present support structure, rather than being a part of the display screen as taught in the prior art, can be readily manufactured as a free-standing unit. As a result of the free-standing nature of the support structure, manufacture of a display is made considerably less expensive and technically much easier by allowing easier coating of phosphors, metals, and thin films onto the display screen or backing plate of the display (since they lack the ribs making up the supports). Also as a result of the free-standing nature of the support structure, manufacture of the support structure itself and installation within the display is also easier and less expensive. Furthermore, the free-standing nature of the support structure permits the deposition of conductive metal layers and resistive materials for field reduction purposes, application of low secondary emission coatings, and creation of the flutings and end shaping of the structure.

Figure 16:
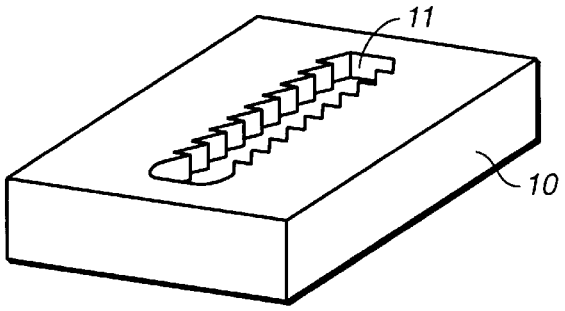
FIG. 16 is a perspective view of a die that may be used to make the described support structures.
Figure 17:
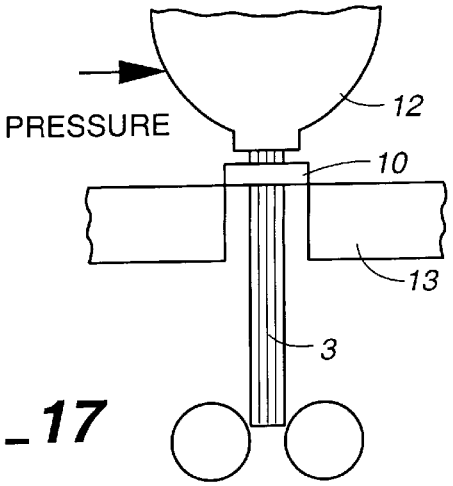
FIG. 17 illustrates a method making the described support structures.

A preferred method of making the present support structure, shown in FIG. 17, uses glass. The glass can be heated in a glass furnace 12 under pressure and pulled through a die 10 which imparts to the glass the desired fluting of the support sides and/or shaping of the support structure edges in a continous process. The die 10, having a desired aperture 11, is shown in greater detail in FIG. 16. The glass stream 3 so formed can then be pulled through a sputtering device 13 which can be used to sputter various coatings onto the glass to seal the glass, provide a resistive coating, provide a low secondary emission coating or to provide a layer along the edges to ensure continous contact with the anode and cathode. The glass stream can then be cut to the desired length through a simple glass cutting process to yield the final free standing support structure.

It will be appreciated by those of ordinary skill in the art that the invention can be embodied in other specific forms without departing from the spirit or essential character thereof. The presently disclosed embodiments are therefore considered in all respects to be illustrative and not restrictive. The scope of the invention is indicated by the appended claims rather than the foregoing description, and all changes which come within the meaning and range of equivalents thereof are intended to be embraced therein.

What is claimed is:

1. A flat panel display device, comprising:

a cathode structure including a plurality of field emitters formed on a first substrate for producing beams of electrons;

an anode structure including cathodoluminescent material formed on a second substrate; and a plurality of discrete spacers having a substantially flat top surface and, substantially parallel thereto, a substantially flat bottom surface, said spacers adjoining the cathode structure and the anode structure for maintaining spacing of the cathode structure and the anode structures, and having a sawtooth profile formed by a succession of substantially parallel edges, parallel to the cathode structure, and inwardly angled edges.

2. The apparatus of claim 1, wherein the spacer is coated with a material having low secondary electron emission characteristics.

3. The apparatus of claim 2, wherein the spacer is formed of a substantially non-porous material.

4. The apparatus of claim 3, wherein the spacer is formed of glass.

5. The apparatus of claim 2, wherein the spacer is coated with a substantially non-porous material.

6. The apparatus of claim 2, wherein the spacer is coated with chromium oxide.

7. The apparatus of claim 1, wherein the spacer is formed of a material having low secondary electron emission characteristics.

8. The apparatus of claim 1, wherein the side surfaces are contoured so as to form in cross section a narrow region adjacent to one of the top surface and the bottom surface.

9. The apparatus of claim 8, wherein the spacer's side surfaces in said narrow region and said one of the top surface and the bottom surface are coated with a high resistivity conductive material of a thickness which is greatest in a vicinity of said one of the top surface and the bottom surface, thereby exhibiting least resistance, and which decreases at progressively greater distances from said one of the top surface and the bottom surface, thereby exhibiting progressively greater resistance.

10. The apparatus of claim 9, wherein the resistive layer is of a semiconducting material.

11. The apparatus of claim 1, wherein the side surfaces contain a plurality of channels parallel to the top and bottom surfaces.

12. The apparatus of claim 11, wherein the side surfaces contain a number of channels related to a differential voltage to be impressed across the spacer and a voltage threshold of a material of which the spacer is formed, below which the secondary emission coefficient of the material is less than one.

13. The apparatus of claim 11, further comprising a low secondary emission coating coated on regions of at least one of the side surfaces visible when viewed from an angle, including peaks formed as part of said channels and facing said one of the top and bottom edges.

14. The apparatus of claim 13, wherein said low secondary emission coating is coated on regions including one of the top and bottom surfaces.

15. The apparatus of claim 1, wherein the spacer is formed of an insulative material.

16. The apparatus of claim 15, wherein said insulative material has a resistivity on the order of $10^{11}$ ohm-centimeters.

17. The apparatus of claim 16, wherein said insulatvie material is doped glass.

18. The apparatus of claim 15, wherein the spacer's side surfaces are coated with a high-resitivity, conductive material that decreases charge relaxation time along said side surfaces.

19. The apparatus of claim 18, wherein said material is a compound of silicon oxide and from 5 to 20% chrome.

20. The apparatus of claim 1, wherein one of the top surface and the bottom surface is coated with a conductive layer.

21. The apparatus of claim 20, wherein a different one of the top surface and the bottom surface is also coated with a conductive layer.

22. The apparatus of claim 20, wherein said conductive layer is a compound of silicon oxide and from 5 to 20% chrome.

* * * * *